United States Patent [19]

Dobson

[11] 4,145,105

[45] Mar. 20, 1979

[54] APPARATUS FOR PREVENTING ACCIDENTAL DISCONNECTION OF ELECTRICAL CORDS

[76] Inventor: James H. Dobson, 328 Woodcrest, Sulphur Springs, Tex. 75482

[21] Appl. No.: 873,795

[22] Filed: Jan. 31, 1978

[51] Int. Cl.[2] ..... H01R 13/54

[52] U.S. Cl. ..... 339/75 P

[58] Field of Search ..... 339/210 R, 75 R, 75 P, 339/39, 103 R, 103 M, 91 R

[56] References Cited

U.S. PATENT DOCUMENTS

| | | | |
|---|---|---|---|
| 2,406,567 | 8/1946 | Schueneman | 339/75 P |
| 2,725,543 | 11/1955 | Tanner | 339/91 R X |
| 2,761,109 | 8/1956 | Hacker | 339/75 R |
| 2,913,791 | 11/1959 | Martin | 339/103 R |
| 3,014,194 | 12/1961 | Berglund | 339/75 P |
| 3,048,810 | 8/1962 | Steen | 339/75 P |

*Primary Examiner*—Joseph H. McGlynn
*Assistant Examiner*—John S. Brown

[57] ABSTRACT

A device for preventing the accidental disconnection of electrical cords comprising a first section and a second section. The first section has a conical-shaped plug receptacle adapted to receive any of a plurality of different sized, commercially available electrical plugs and a detent slot for holding the cord affixed to the plug. The second section has a detent slot adapted to receive a second electrical cord having a mating plug thereon. An adjustable means connects the first and second sections together to thereby prevent the accidental disconnection of the plugs when they are in a mated position.

5 Claims, 4 Drawing Figures

10
11
12
13
14
14a
15
16
20
21
22
23
24
25
30
31
33
34
2
3
a
b
c
d

APPARATUS FOR PREVENTING ACCIDENTAL DISCONNECTION OF ELECTRICAL CORDS

BACKGROUND OF THE INVENTION

This invention relates to a device for preventing the accidental disconnection of electrical cords and more particularly relates to a device which is adapted to secure two electrical cords together once their respective plugs are mated to prevent accidental disconnection.

Most power tools such as hand saws, drills, electric lawnmowers and edgers, hedge clippers, and the like, require the use of long extension cords to supply power between an electrical outlet and the tool. Anyone who has ever used such tools knows that at sometime during the operation thereof, the extension cord may get caught on some obstacle where normal movement of the tool will pull the plug on the tool cord out of the plug on the extension cord. Not only is this annoying but can be time consuming for a workman who has to stop work to re-connect the cords.

Many known devices have been proposed for maintaining the connection between electrical cords. Such devices are disclosed in U.S. Pat. Nos. 3,223,958; 3,344,393; 3,383,639; 3,475,716; 3,613,046; 3,922,055; and 3,999,828. While each of these devices should function satisfactorily to prevent the accidental disconnection of electrical plugs, each has some feature which detracts from their use in a wide variety of situations. For example, some of these devices are designed for a specific size of cord and/or plugs, others are designed to be permanently attached to one of the cords involved, others are relatively complicated in construction, and others required some tool to assemble and disassemble.

Therefore, for such a device to find widespread commercial application, it should be capable of being used with almost any size commercial plugs and/or cords without requiring any extensive modification or adaptation for the different plugs and/or cords. It should be simple in construction, simple to use, and be capable of use without requiring additional tools to assemble or disassemble.

SUMMARY OF THE INVENTION

The present invention provides an easily constructed, inexpensive device for preventing accidental disconnection of electrical cords which can be used with almost any commercially available size of electrical cords and/or plugs. The device can be easily installed and removed without requiring any tools of any kind. The device is constructed so that a single device can be used for almost any known standard size of cord and/or plug without any complicated adjustment being required.

The present device is comprised of two sections. The first section has a receptacle preferably for the female plug, i.e., socket, and a detent slot for receiving the cord connected to the female plug. The second portion has a detent slot for receiving the cord connected to a second plug, e.g. the male plug. An adjustable means is provided for releasably connecting the first and second sections so that they be moved toward each other and secured in one of a plurality of available fixed positions when the male and female plugs are mated to thereby secure the plugs together and prevent the accidental disconnection of same. This adjustable means is comprised of a strap on the second section which has a plurality of detents thereon which cooperate with a slot on the first section to provide the plurality of fixed positions between the first and second sections. The detents can easily be released when desired to remove the device and disconnect the plugs.

BRIEF DESCRIPTION OF THE DRAWINGS

The actual construction, operation, and the apparent advantages of the present invention will be better understood by referring to the drawings in which like numerals identify like parts in the different figures and in which.

DETAILED DESCRIPTION OF THE INVENTION

Figures 1, 2, 3, 4:
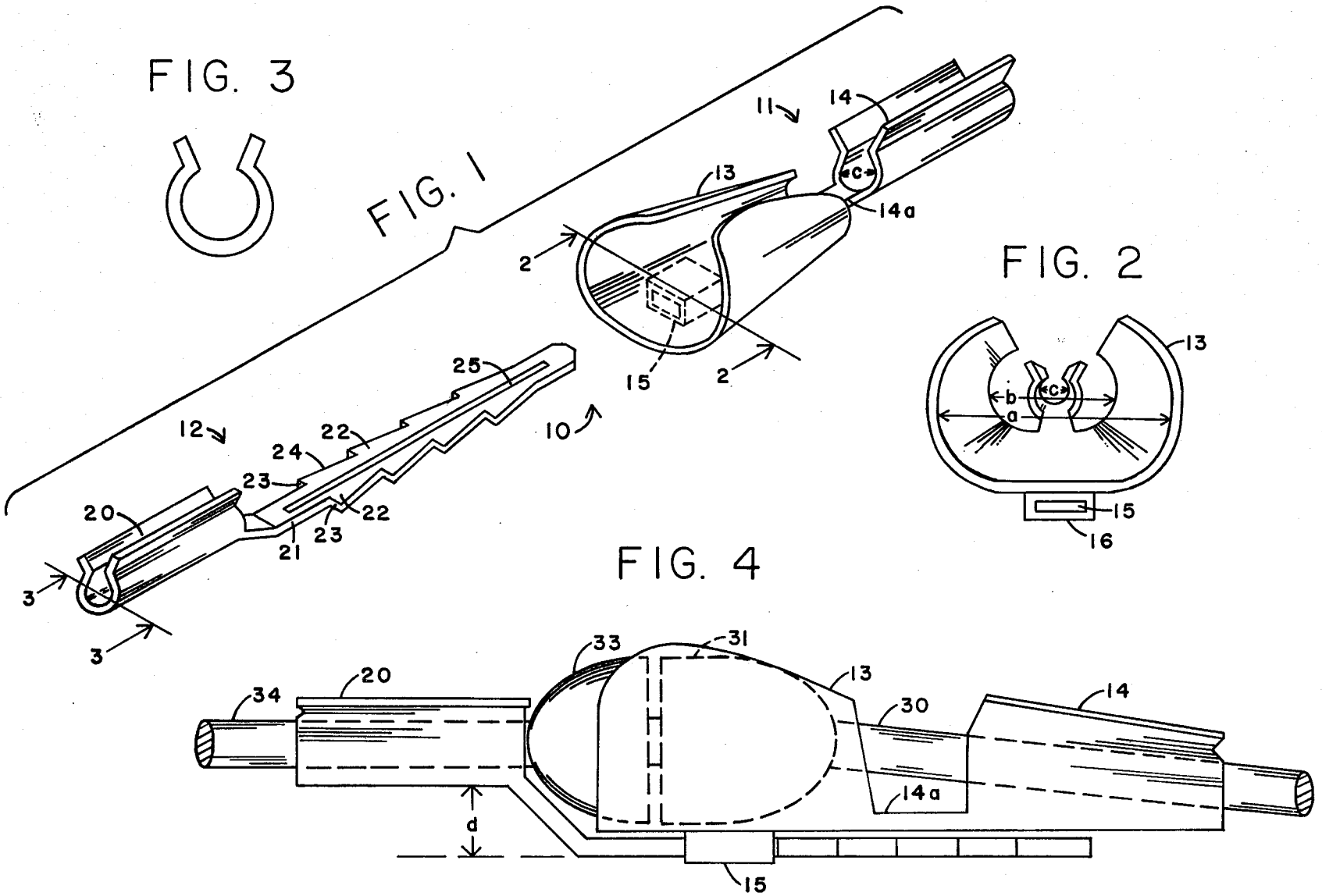
FIG. 1 is an exploded, perspective view of the two sections of the present invention.
FIG. 2 is an end view of the first section of the invention taken along line 2—2 of FIG. 1.
FIG. 3 is an end view of the second section of the invention taken along line 3—3 of FIG. 1.
FIG. 4 is a side view of the two sections joined together to prevent the accidental disconnection of a male and female plug when the plugs are in a mated position.

Referring more particularly to the drawings, FIG. 1 discloses a device 10 comprised of a first section 11 and a second section 12. Preferably, both sections 11 and 12 are constructed of a material, e.g. plastic, rubber, etc., which is easily molded into the desired configuration using techniques well known in the art. First section 11 has a plug receptacle 13 and a cord detent slot 14 spaced from receptacle 13 and joined thereto by length 14*a*.

Receptacle 13 is substantially conical shaped and is open at both ends and along its top as clearly shown in FIGS. 1 and 2. The dimensions of receptacle 13 are such that it will receive and hold any of the different size plugs (preferably the female plug or socket) which are commonly found on most commercially available extension cords. Since most of these female plugs vary in one-eighth of an inch increments from 1 to 2 inches in diameter, receptacle 13 having a diameter a of $2\frac{1}{4}$ inches and tapering to a diameter b of 7/16 of an inch within a length of $2\frac{1}{2}$ to 3 inches will easily accommodate most female plugs, i.e., sockets, which are likely to be encountered in day-to-day operations. Further, since the diameter of the electrical cords attached to the female plugs vary, the diameter c of detent slot 14 is also sized (i.e., $\frac{1}{2}$ to $\frac{3}{8}$ of an inch) so that it will receive cords having diameters in the commercially available range. It is understood that since sections 11 and 12 are made from molded material such as plastic or rubber, detent slot 14 will have a certain flexibility so that when a cord is snapped into detent slot 14 it will be held there by the natural resiliency of the material. Ear 15 having a slot 16 therethrough is formed on the underside of receptacle 13 for a purpose explained below.

Second section is comprised of detent slot 20 sized in the same manner as detent slot 14 so that it too will receive any of the different diameter cords normally found on commerically available power tools. Affixed to detent slot 20 is strap 21 which has a plurality of detents 22. As clearly shown in FIG. 1, each detent 22 comprises a pair of triangular projections on either side of strap 21. Each triangular projection has a leading edge 23 which is formed at a slight reverse angle with respect to strap 21 and a tapered or camming edge 24. A slot 25 is cut through the center of strap 21 along its length adjacent detents 22, the purpose of which will be explained below. As best seen in FIG. 4, second section 12 is formed so that strap 21 where it is connected to detent slot 20 is offset by a distance d, e.g. 3/16 of an inch, to compensate for various size male plugs and allow for good alignment between the male and female plugs when device 10 is in use.

In operation, strap 21 of second section 12 is positioned in slot 16 in ear 15 on first section 11 and pulled until the first detent 22 pass through ear 15 and edge 23 springs out to engage the back of ear 15. The length of ear 15 will be slightly less than the length of detent 22. The tapered edges 24 of the detents 22 and the compressibility of strap 21 due to slot 25 allow the detents to be cammed inward so the strap can be easily pulled through ear 15 in one direction. However, the reverse angle side 24 of detents 22 will engage ear 15 and prevent movement of strap 21 in the other direction. To remove strap 21 from ear 15, the detents have to be physically pressed inward against slot 25 while at the same time pulling strap 21 in the releasing direction.

With sections 11 and 12 loosely assembled, an extension cord 30 (see FIG. 4) having a female plug 31 is positioned in section 11. The cord 30 is pressed into detent slot 14 and is pulled within detent slot 14 to move plug 31 into receptacle 13 until it is securely wedged within the taper of the receptacle. Male plug 33 on power tool cord 34 is then connected to female plug 31 and cord 34 is pressed into detent slot 20. Strap 21 is then pulled through ear 15 until the forward edge of detent slot 20 contacts male plug 33 and the appropriate detent 22 is engaged. Note, cord 34 will slide in detent slot 20. The lengths of each detent is sized (e.g. each detent 22 being $\frac{1}{4}$ of an inch in length) so that for the different sizes of commercially available male plugs 33, detent slot 20 will either snuggly abut plug 33 or be sufficiently close to the plug to prevent disconnection when device 10 is assembled in its operable position.

It can be seen that the present invention provides a single device that can be used with a variety of commercially available power tools and extension cords. This is important since a workman has only to buy one device to satisfy a variety of needs. Also, no tools are needed to assemble or disassemble the device into or out of its operable position. Still further, where one extension cord is predominantly used, section 11 can be left dangling on the extension cord 30 when not in use with section 12 loosely coupled thereto thereby being readily available when required.

What I claim is:

1. A device for preventing the accidential disconnection of two electrical cords, said device comprising:

a first separate section having a plug receptacle and a detent slot thereon, said detent slot adapted to receive a first electrical cord having a first plug thereon which in turn will be received in said plug receptacle on said first separate section;

a second separate section having a detent slot thereon adapted to receive a second electrical cord having a second plug thereon; and adjustable means for connecting said first and second separate sections together in a position to secure said first and second plugs together when said plugs are in a connected position.

2. The device of claim 1 wherein said adjustable means comprises:

a strap on said second separate section having a plurality of detents thereon; and a slot on said first separate section adapted to receive said strap and said detents thereon.

3. The device of claim 2 wherein said detents comprises:

projections spaced on either side of said strap, each of said projections having a camming surface and a second surface whereby said strap can be easily moved through said slot on said first section in one direction but is prevented from movement in the other direction.

4. The device of claim 2 wherein said receptacle is substantially conical in shape and being open at both ends.

5. The device of claim 4 wherein both said detent slots on said first section and said second section are open along their top edges.

* * * * *